US008678858B2

(12) United States Patent
Islam

(10) Patent No.: US 8,678,858 B2
(45) Date of Patent: Mar. 25, 2014

(54) COAXIAL CONNECTOR INTERCONNECTION CAP

(75) Inventor: Nahid Islam, Westmont, IL (US)

(73) Assignee: Andrew, LLC, Hickory, NC (US)

( * ) Notice: Subject to any disclaimer, the term of this patent is extended or adjusted under 35 U.S.C. 154(b) by 197 days.

(21) Appl. No.: 13/321,609

(22) PCT Filed: Jun. 4, 2010

(86) PCT No.: PCT/US2010/037504

§ 371 (c)(1),
(2), (4) Date: Nov. 21, 2011

(87) PCT Pub. No.: WO2010/141890

PCT Pub. Date: Dec. 9, 2010

(65) Prior Publication Data

US 2012/0064765 A1 Mar. 15, 2012

Related U.S. Application Data

(60) Provisional application No. 61/184,573, filed on Jun. 5, 2009.

(51) Int. Cl.
*H01R 9/05* (2006.01)

(52) U.S. Cl.
USPC ..... 439/578

(58) Field of Classification Search
USPC ..... 439/578–585, 394; 174/88 C
See application file for complete search history.

(56) References Cited

U.S. PATENT DOCUMENTS

| | | | | |
|---|---|---|---|---|
| 4,698,028 | A * | 10/1987 | Caro et al. | 439/271 |
| 5,785,554 | A * | 7/1998 | Ohshiro | 439/584 |
| 5,934,937 | A | 8/1999 | McCarthy | |
| 6,607,398 | B2 * | 8/2003 | Henningsen | 439/578 |
| 6,890,208 | B2 | 5/2005 | McCarthy | |
| 6,893,290 | B2 * | 5/2005 | Buenz et al. | 439/578 |
| 7,029,327 | B2 * | 4/2006 | Devine | 439/587 |
| 7,077,700 | B2 * | 7/2006 | Henningsen | 439/583 |
| 7,513,795 | B1 | 4/2009 | Shaw | |
| 2004/0219833 | A1 * | 11/2004 | Burris et al. | 439/578 |
| 2008/0003873 | A1 * | 1/2008 | Henningsen | 439/578 |
| 2008/0102696 | A1 | 5/2008 | Montena | |
| 2009/0053931 | A1 | 2/2009 | Islam | |
| 2010/0087090 | A1 * | 4/2010 | Islam | 439/578 |

FOREIGN PATENT DOCUMENTS

EP 0027680 4/1981

* cited by examiner

*Primary Examiner* — R S Luebke
*Assistant Examiner* — Harshad Patel
(74) *Attorney, Agent, or Firm* — Babcock IP, PLLC

(57) ABSTRACT

A coaxial connector is combined with an inner conductor interconnection cap, for interconnection with a coaxial cable. The interconnection cap is provided with a bore adapted to seat upon and circumferentially contact an outer diameter of the inner contact and an outer diameter of the inner conductor. The interconnection cap extends along the inner contact to cover at least a contact portion at a cable end of the inner contact to enclose an interconnection between the inner conductor and the inner contact. Sealant may be applied to the interconnection to improve seal performance and the dimensions and materials of the interconnection cap may be adjusted to modify characteristic impedance for return loss optimization with respect to specific coaxial cables.

18 Claims, 10 Drawing Sheets

COAXIAL CONNECTOR INTERCONNECTION CAP

CROSS REFERENCE TO RELATED APPLICATIONS

This application claims the benefit of U.S. Provisional Patent Application Ser. No. 61/184,573 "Coaxial Connector for Solid Outer Conductor Coaxial Cable" filed Jun. 5, 2009 by Nahid Islam and Al Cox, currently pending and hereby incorporated by reference in its entirety.

BACKGROUND OF THE INVENTION

1. Field of the Invention

The invention relates to electrical connectors for coaxial cable. More particularly the invention relates to a coaxial cable interconnection cap that provides an exchangeable tuning element and/or environmental seal for at least the inner conductor to inner contact electrical interconnection.

2. Description of Related Art

Prior coaxial connectors typically rely upon multiple seals between the connector, coaxial cable and/or interface element joints to prevent entry of moisture and/or humid air into the coaxial connector. The plurality of environmental seals significantly increases the complexity of the coaxial connector manufacture as well as assembly and installation procedures.

Coaxial connectors may be tuned for impedance matching with the intended coaxial cable and/or operating frequency to improve electrical performance. However, tuning a coaxial connector for each likely coaxial cable and/or operating frequency may require manufacture and inventory of a large number of different coaxial connector designs. An alternative method of impedance matching a connector with a specific coaxial cable is to apply an additional cable specific coring tool to selectively remove foam dielectric from the coaxial cable end. Such coring tools are costly and not always precise in the amount of dielectric removed/impedance matching achieved.

Dielectric elements have been applied within coaxial connectors as supporting insulators for the inner contact and/or proximate the interconnection between the inner conductor and an inner contact, to align the inner contact concentric with the outer conductor, create/enhance an inward bias upon the inner conductor by the inner contact and/or to support ramp structures for guiding and/or flaring the outer conductor during connector to cable attachment.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Prior coaxial cables typically have inner and outer conductors made from copper and copper alloy. The inventor has recognized that new coaxial cable configurations and/or materials such as inner and/or outer conductors of aluminum and/or aluminum with copper or other metallic outer coating may require improved protection of the electrical interconnection, especially when these materials are connected to the dissimilar metals commonly applied to electrical connectors. Further, prior coaxial connector designs originally prepared for specific prior copper conductor coaxial cables may require significant impedance matching redesign prior to use with these new coaxial cable configurations.

The environmental seals in prior coaxial connectors are typically located around entry paths through the connector body and therefore do not protect the electrical interconnection between the inner conductor and the inner contact from any moisture which (a) may migrate past environmental seals of the connector body, (b) is sealed within the connector during installation and/or (c) may migrate to the electrical interconnection area along the inside of the coaxial cable.

An installation error and/or failure of any one of these connector body environmental seals may allow moisture and/or humid air to enter the connection areas of the connector where it can pool and cause corrosion, oxidation, increased contact resistance and/or IMD resulting in significant performance degradation of the electrical connections.

In the case of metals such as aluminum, an oxide film is formed on surfaces exposed to atmosphere in a very short time (within seconds). Also, accelerated galvanic corrosion can occur between aluminum and other metals in presence of an electrolytic solution, such as water.

In a coaxial connector incorporating an interconnection cap according to the invention, local isolation of the interconnection area is provided, reducing the overall seal area required and improving the reliability of the environmental seal. Further, modifications to the materials and/or dimensions of the interconnection cap may be cost effectively applied to enhance an impedance match of the coaxial connector with a specific coaxial cable, such as smooth wall or corrugated outer conductor coaxial cable, without requiring extensive modifications to the remainder of the associated coaxial connector.

Figure 1:
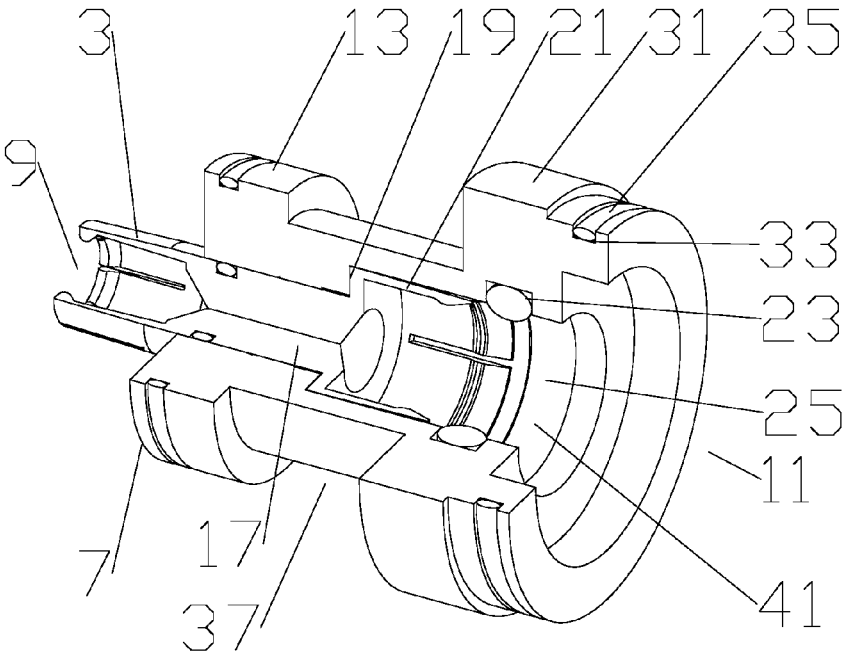
FIG. 1 is a schematic isometric 90 degree cut-away view of a first exemplary interconnection cap.
Figure 2:
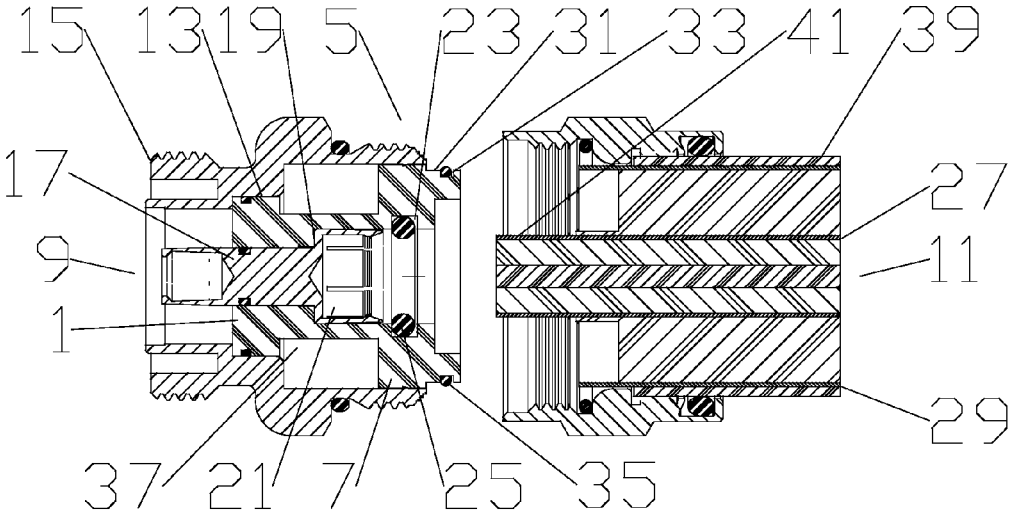
FIG. 2 is a schematic isometric 90 degree cut-away view of FIG. 1, including an inner contact.
Figure 3:
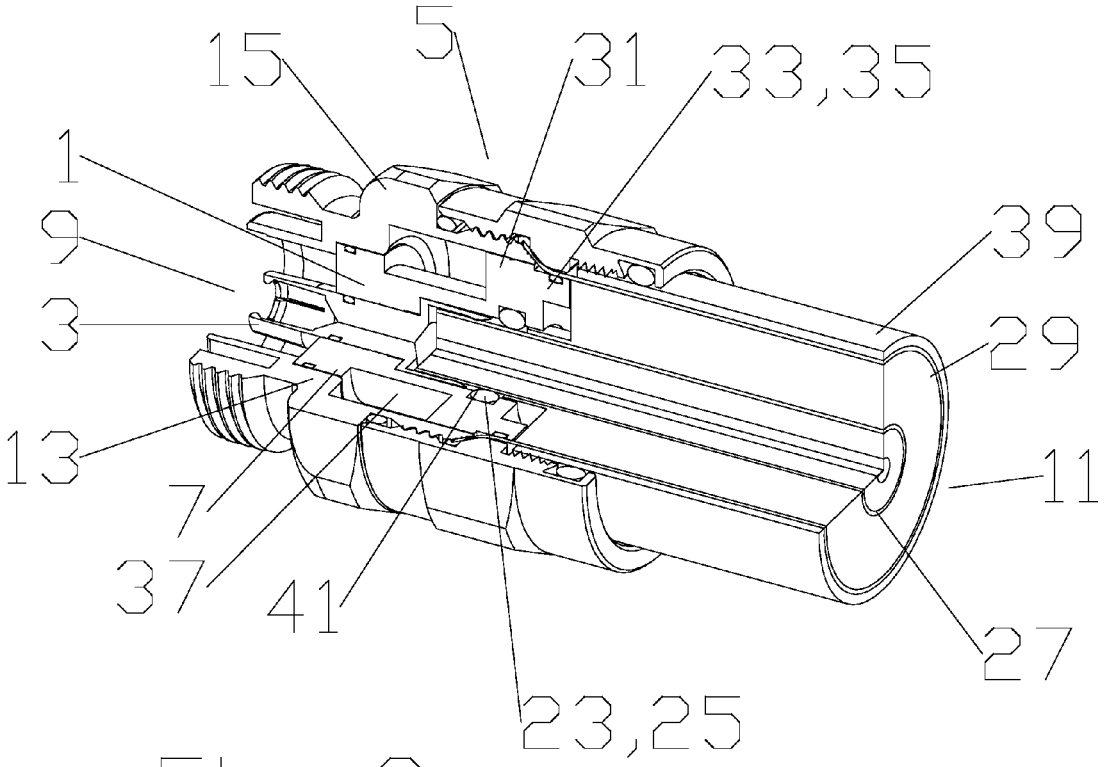
FIG. 3 is a schematic isometric 90 degree cut-away side view of a coaxial connector assembly with the interconnection cap of FIG. 1, with a coaxial cable attached.
Figure 4:
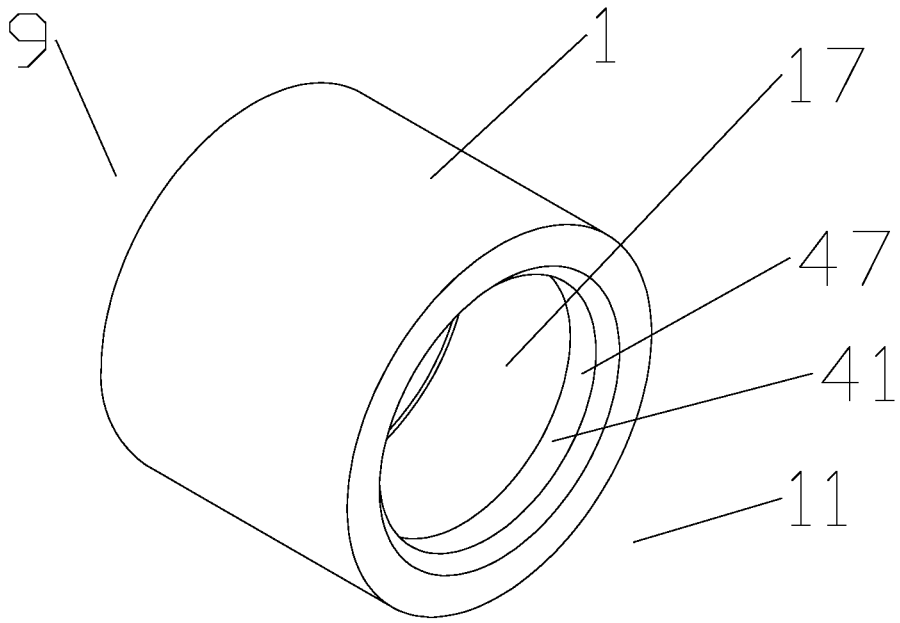
FIG. 4 is a schematic isometric view of another embodiment of an interconnection cap.
Figure 5:
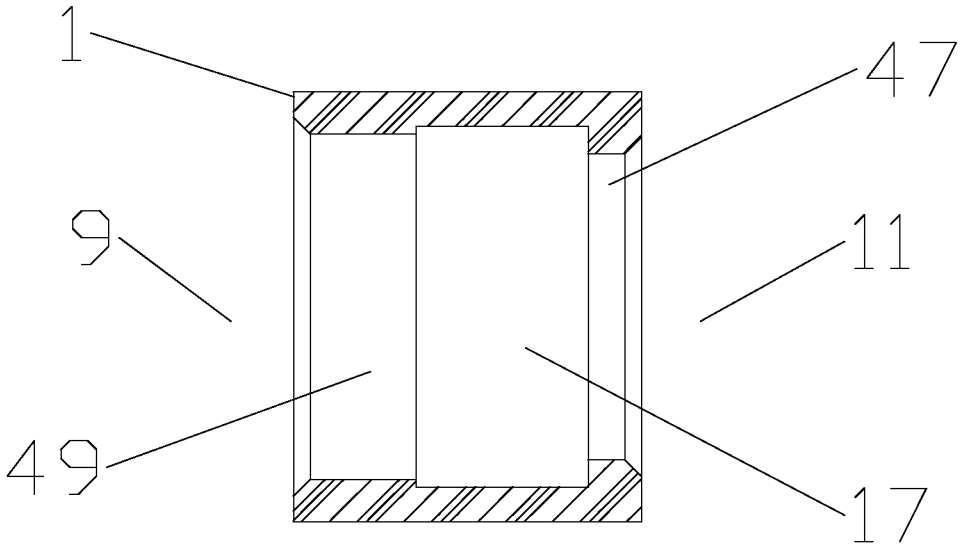
FIG. 5 is a schematic cut-away side view FIG. 4.
Figure 6:
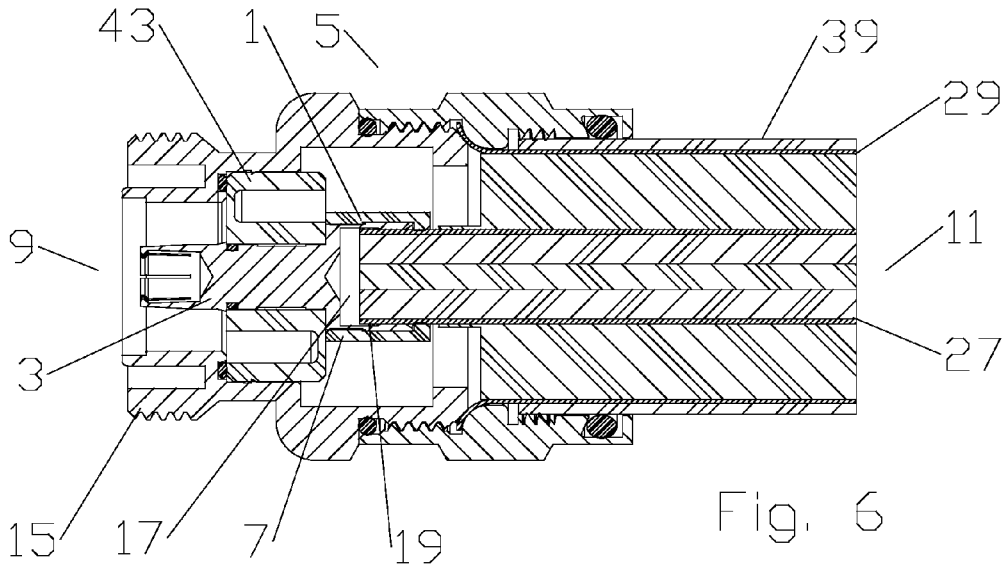
FIG. 6 is a schematic isometric 90 degree cut-away side view of a coaxial connector assembly with the interconnection cap of FIG. 4, with a coaxial cable attached.
Figure 7:
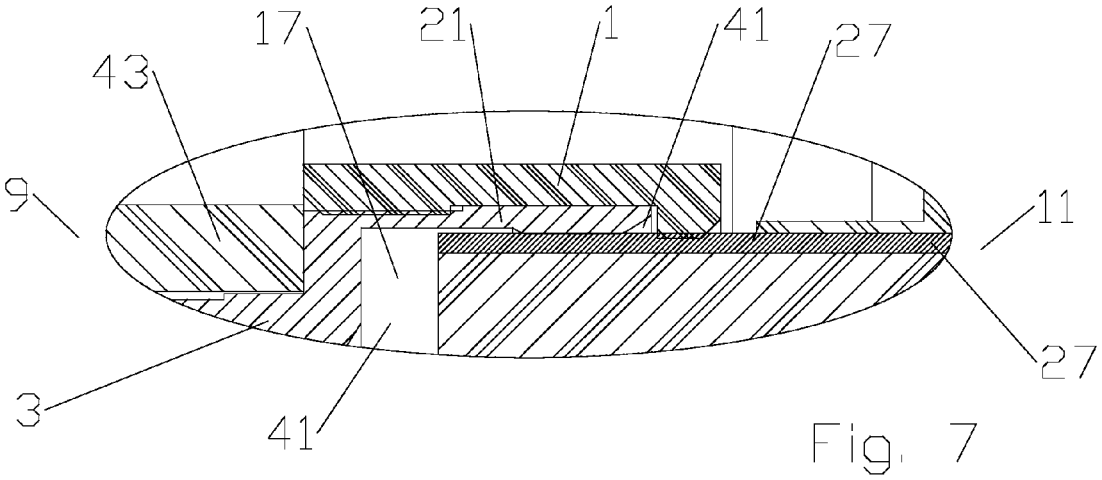
FIG. 7 is a close-up view of FIG. 6.

A first embodiment of an interconnection cap 1, as shown in FIGS. 1-3, also supports the inner contact 3 within a coaxial cable connector assembly 5 replacing the traditional inner contact supporting insulator. The interconnection cap 1 may be formed as a unitary monolithic body 7, for example by injection molding, with a connector end 9 and a cable end 11 provided with a mounting portion 13 proximate the connector end 9. The outer diameter of the mounting portion 13 may be dimensioned to seat the interconnection cap 1 within a connector body 15 of the coaxial cable connector assembly 5.

One skilled in the art will appreciate that connector end 9 and cable end 11 are applied herein as identifiers for respective ends of both the overall coaxial connector assembly 5 and also of discrete elements of the assembly described herein, to identify same and their respective interconnecting surfaces according to their alignment along a longitudinal axis of the coaxial connector assembly 5 between a connector end 9 and a cable end 11.

A bore 17 through the dielectric body 7 is dimensioned to seat the inner contact 3 therein, retaining the inner contact 3 coaxial with the connector body 15. The bore 17 may be formed with an inner diameter that increases between the connector end 9 and the cable end 11, for example via a step 19 against which an increased diameter contact portion 21 of the inner contact 3 abuts, preventing further movement of the inner contact 3 towards the connector end 9. The contact portion 21 receives and engages the inner conductor 27 in an electro-mechanical interconnection, for example via a spring basket or other plurality of inward biased spring fingers.

An annular first seal groove 23 may be provided in an inner diameter of the bore 17 proximate the cable end 11. An inner conductor seal 25 may be seated in the first seal groove 23, for example an o-ring or other form of annular gasket. To improve the seal characteristics of inner conductor seal 25 and/or minimize the chance for misplacing and/or unseating the inner conductor seal 25 during assembly and/or cable to connector installation, the inner conductor seal 25 may be over-molded upon the dielectric body 7. The inner conductor seal 25 is dimensioned to seal between the interconnection cap 1 and the inner conductor 27 as the inner conductor 27 is inserted to couple with the contact portion 21 of the inner contact 3.

Similar to the sealing of the electrical connection between the inner conductor 27 and the inner contact 3, the interconnection cap 1 may also be configured to provide an alignment surface for and/or seal against the inner diameter of the outer conductor 29, aligning the inner contact 3 concentric with the outer conductor 27. Thereby, as the coaxial cable is manipulated with respect to the coaxial connector after interconnection the concentric alignment of the inner contact 3 and outer conductor 27 is maintained, reducing the tendency for such misalignments and/or shifts of increased magnitude along contact surfaces to generate IMD.

For example, an outer diameter aligning portion 31 of the dielectric body 7 proximate the cable end 11 may be provided with an annular second seal groove 33 around the outer diameter. The second seal groove 33 receives an outer conductor seal 35 dimensioned to seal between the interconnection cap 1 and an inner diameter of the outer conductor 29 when the outer conductor 29 is coupled to the connector body 15. The outer conductor seal 35 may also be an o-ring or other form of annular gasket and/or may be over-molded directly upon the second seal groove 33.

To reduce material costs and overall connector assembly weight, a material reduction groove 37 may be located between the mounting portion 13 and the aligning portion 31. Depending upon the dimensions of the coaxial cable 39 and the selected connection interface for the coaxial cable connector assembly, the diameter of the mounting portion 13 may be smaller than the diameter of the aligning portion 31. To locate the outer conductor seal 35 at a position for contacting the inner diameter of the outer conductor 29, the interconnection cap 1 may extend beyond the connector body 15 at the cable end 11. Further, the aligning portion may be provided with step and/or ramp surfaces to align the outer conductor seal 35 with the outer conductor 29, for example where the outer conductor inner diameter is the same as the inner diameter of a body bore of the connector body 15 at the cable end 11.

In addition to a seal design to prevent aluminum oxidation and/or corrosion, an interconnection cap 1 according to the invention may also include a surface sealant 41 (notation 41 in the various figures indicates several possible general surface sealant 41 application area(s), as the surface sealant 41 may be applied in coating thicknesses that are too thin to graphically represent in the various figures) such as an oxidation and/or corrosion inhibitor coating or grease. An example of suitable surface sealant(s) is the family of Dostex™ oxide inhibitors available from Dossert Corporation of Waterbury, Conn., US.

The surface sealant 41 may be applied to the inner conductor seal 25, outer conductor seal 29, first seal groove 23, second seal groove 33, inner contact 3, the cable end 11 of the bore 17 and/or the inner conductor 27. A filling of the interconnection area to the exclusion of air upon interconnection is preferred, short of spilling out of the interconnection area.

Where the surface sealant 41 is applied, for example to the inner conductor seal 25 and/or first seal groove 23, displacement of the inner conductor seal 25 into/against the first seal groove 23 as the inner conductor 27 is moved towards the inner contact 3 will spread a coating of the surface sealant 41 upon the inner conductor 27. When the inner contact 3 couples with the surface sealant 41 coated inner conductor 27, the mechanical force of the inner contact 3 will displace the surface sealant 41 from the immediate area of the electrical interconnection, sealing the electrical interconnection from exposure to the atmosphere and any moisture that may be present.

Alternatively, the surface sealant may be applied to exposed surfaces of the electrical interconnection area, coaxial cable connector assembly 5 and/or coaxial cable 39 as a manual step of a method for coupling the coaxial cable connector assembly 5 to the end of the coaxial cable 39.

One skilled in the art will appreciate that the present invention may be easily integrated with existing coaxial connector configurations with a minimum of engineering rework and/or tooling modification. The required modifications may be limited to the exchange of a conventional insulator configuration with an interconnection cap 1 according to the invention.

In another embodiment demonstrated in FIGS. 4-7, the several benefits of the invention may be realized without modifying the traditional inner contact supporting insulator 43. As shown in FIG. 3, the interconnection cap 1 may be formed as a generally cylindrical body dimensioned to seat upon an outer diameter of the contact portion 21 of the inner contact 3 projecting from the cable end 11 of the insulator 43 and sealing against the outer diameter of the inner conductor 27, for example via an inner conductor shoulder 47.

The covering of the contact portion 21 is defined as a covering which forms a surrounding enclosure of the inner contact and inner conductor interconnection, sealing against the inner conductor 27 and against the inner contact 3 at a location which seals the contact portion 21. For example, the contact portion 21 is covered such that any slots or the like between spring fingers forming the spring basket are covered, fully surrounding and sealing the interconnection.

Figure 8:
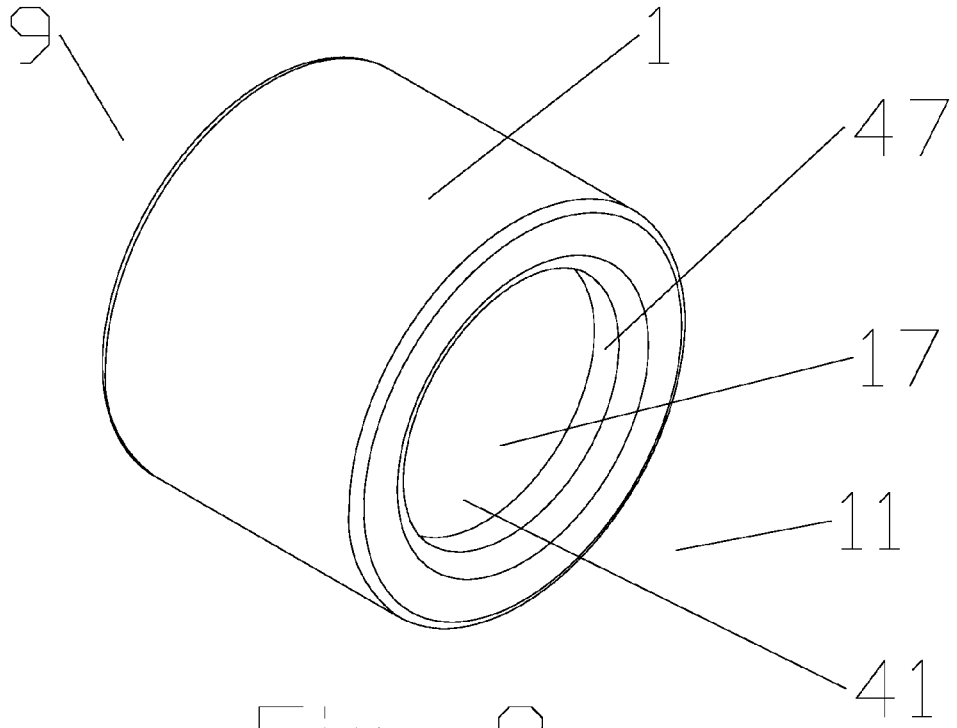
FIG. 8 is a schematic isometric view of another embodiment of an interconnection cap.
Figure 9:
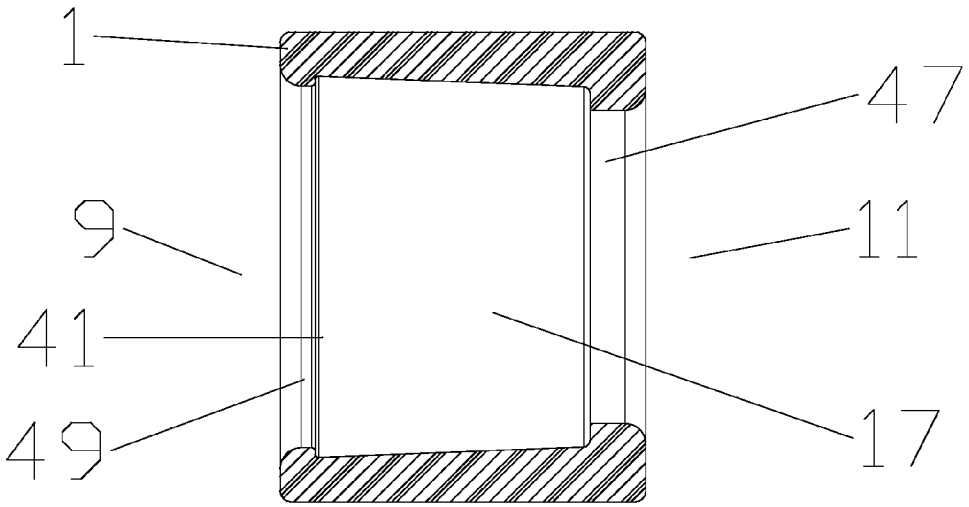
FIG. 9 is a schematic cut-away side view FIG. 8.

As shown for example in FIGS. 8 and 9, the bore 17 may be provided with a taper between a minimum diameter proximate a cable end 11 of the interconnection cap 1 and a maximum diameter proximate a connector end 9 of the interconnection cap 1. Thereby, the bore 17 follows a steady state contour of the contact portion 21, for example the inward direction of the spring basket prior to insertion of the inner conductor 27. To minimize slippage while seated along the taper of the contact portion 21, the interconnection cap 1 may be provided with an inward projecting connector end shoulder 49 dimensioned to engage a groove and/or shoulder feature of the inner contact 3 in a snap fit. When the inner contact 27 contacts and radially spreads the spring basket during insertion, an elastic property of the material selected for the interconnection cap 1, such as an elastomeric material with a high durometer, may provide additional strength to the contact portion 21, enabling the inner contact 3 to be formed from a less expensive material such as brass, instead of the phosphor bronze typically utilized for its spring characteristic.

A stripping feature 51 may be applied to the interconnection cap 1 to provide a scraping action upon the inner conductor outer diameter immediately prior to entry into the interconnection area as a last cleaning of any surface contamination such as residue from dielectric of the coaxial cable 39 that might otherwise foul the interconnection. Alternatively, the scraping feature may be provided with sufficient grip and/or strength to scrape off any surface oxidation that may be present on the inner conductor surface.

Figure 10:
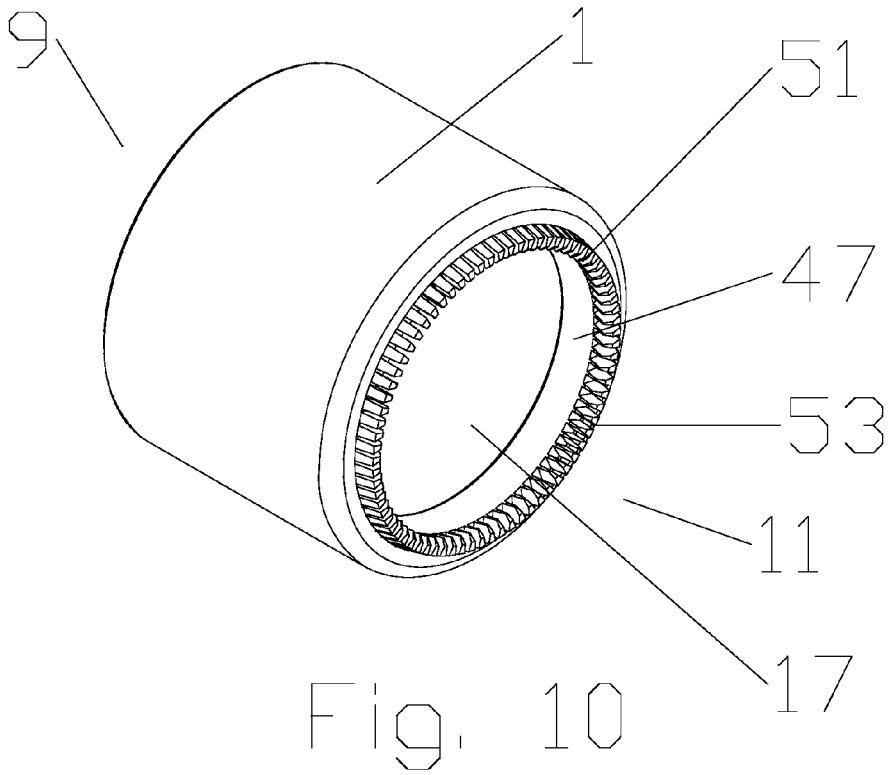
FIG. 10 is a schematic isometric view of another embodiment of an interconnection cap.
Figure 11:
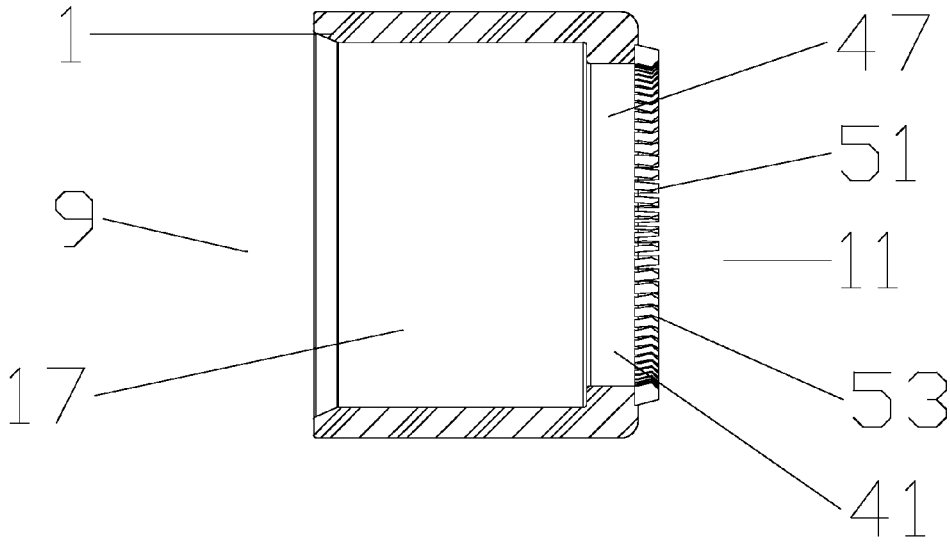
FIG. 11 is a schematic cut-away side view FIG. 10.

For example as shown in FIGS. 10 and 11, the stripping feature 51 may be formed as a plurality of stripping finger(s) 53 provided arrayed around the cable end of the interconnection cap, projecting radially inward.

Figure 12:
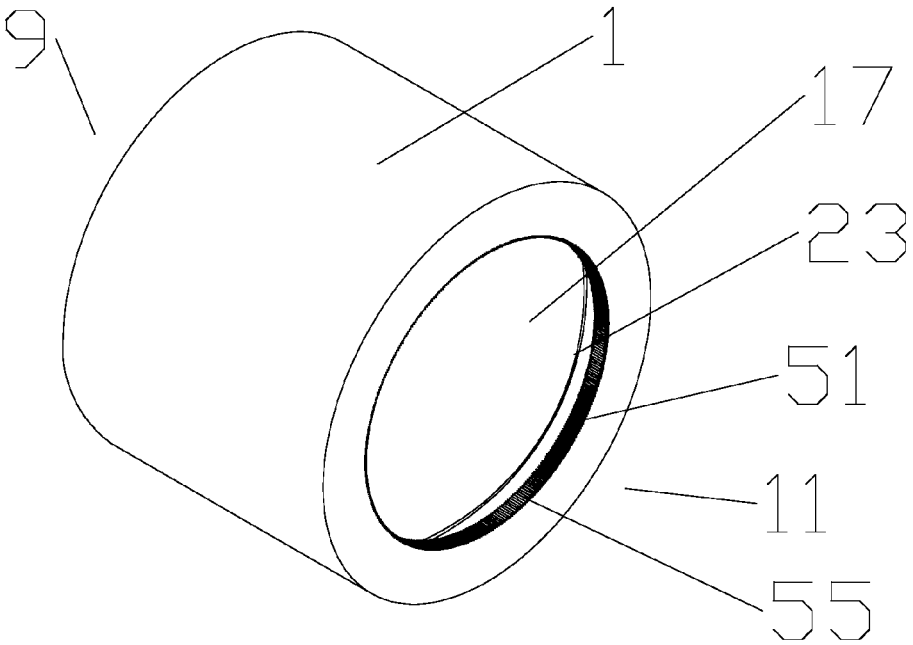
FIG. 12 is a schematic isometric view of another embodiment of an interconnection cap.
Figure 13:
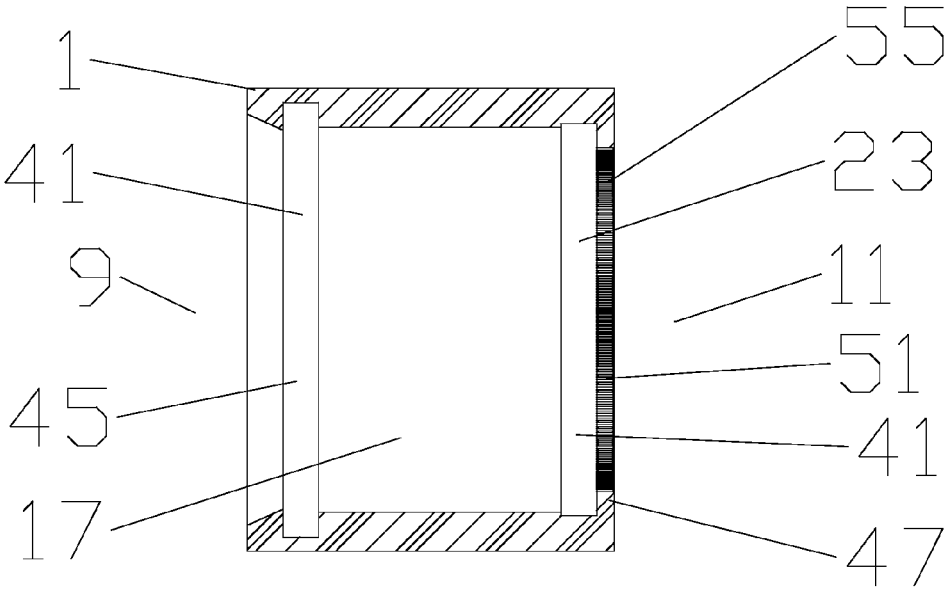
FIG. 13 is a schematic cut-away side view FIG. 12.

For example as shown in FIGS. 12 and 13, the stripping feature 51 may be formed as a scrape surface 55 provided on an inner diameter of the inner conductor shoulder 47. The scrape surface 55 may be formed, for example, as a plurality of longitudinal or annular grooves.

The material selected for the interconnection cap 1 may impact the sealing characteristics. For example, where a material with an elastic characteristic is applied, the material may be relied upon to seal against the inner conductor 27 and contact portion 21 without additional seal features, for example as shown in FIGS. 10 and 11. Alternatively, where a relatively inelastic material is applied, for example where the interconnection cap 1 requires rigidity for supporting the inner contact 3 as in FIGS. 1-3 and/or a metal material is used to obtain a scrape surface 55 as in FIGS. 12 and 13, the first seal groove 23 and a third seal groove 45, provided in the bore 17 proximate the connector end, may be applied as seats for gaskets such as the inner conductor seal 25 and/or for filing with surface sealant 41.

Figure 14:
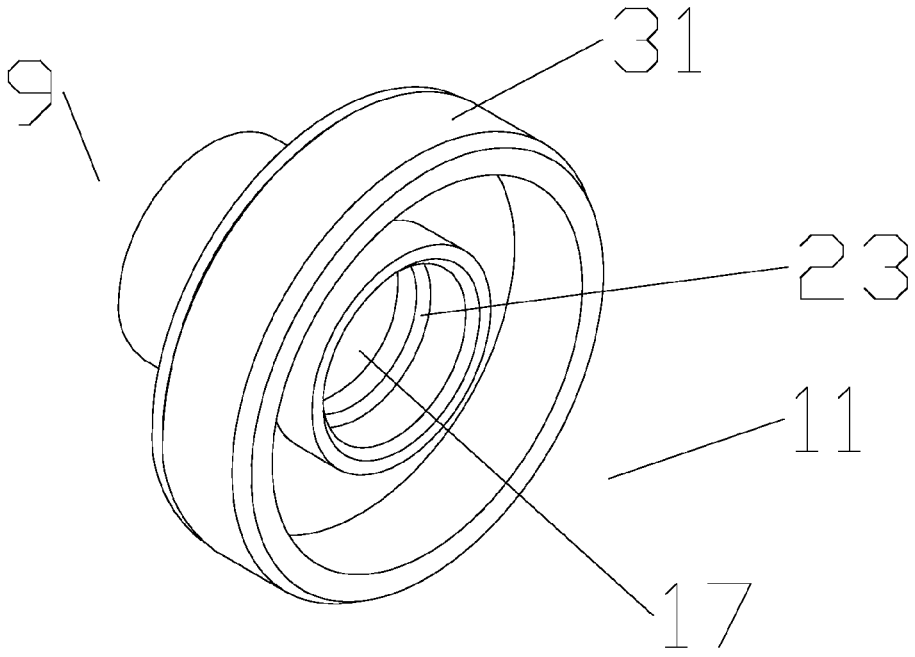
FIG. 14 is a schematic isometric view of another embodiment of an interconnection cap.
Figure 15:
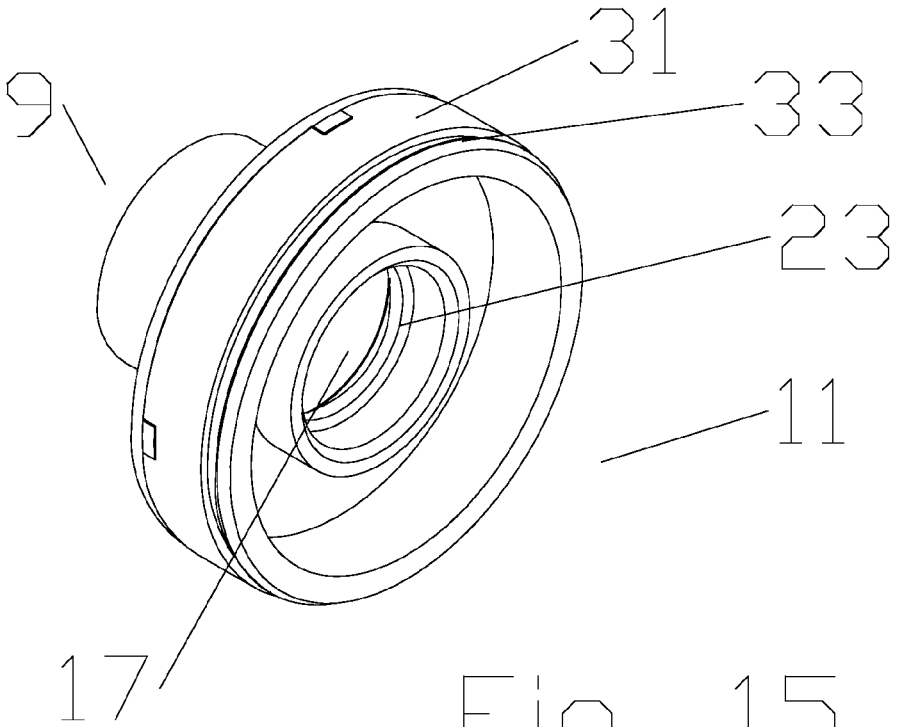
FIG. 15 is a schematic isometric view of another embodiment of an interconnection cap.
Figure 16:
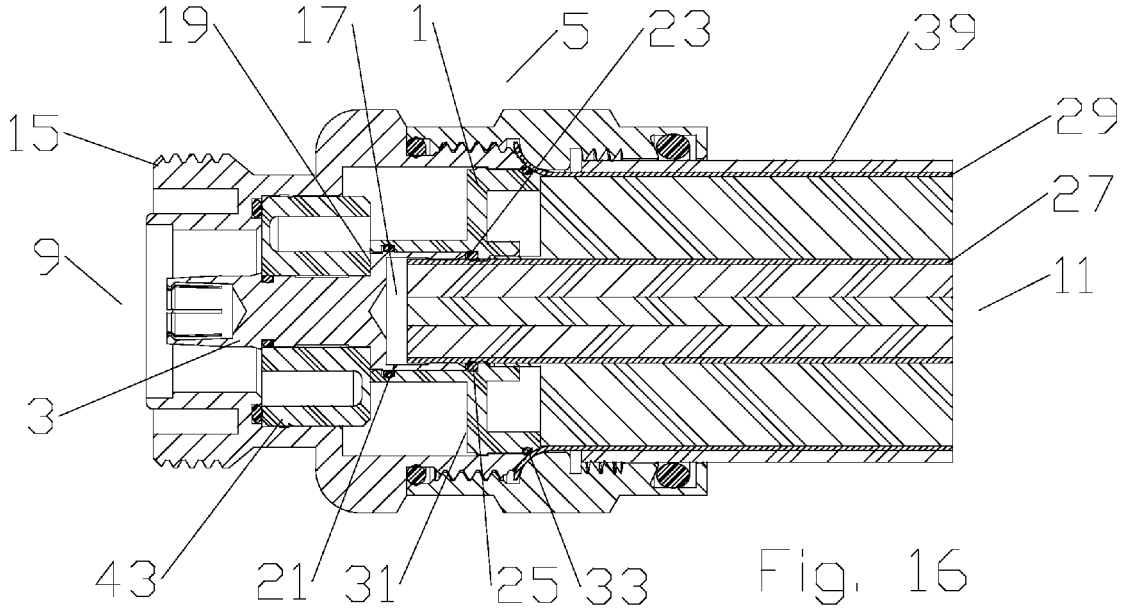
FIG. 16 is a schematic isometric 90 degree cut-away side view of a coaxial connector assembly with the interconnection cap of FIG. 15, with a coaxial cable attached.
Figure 17:
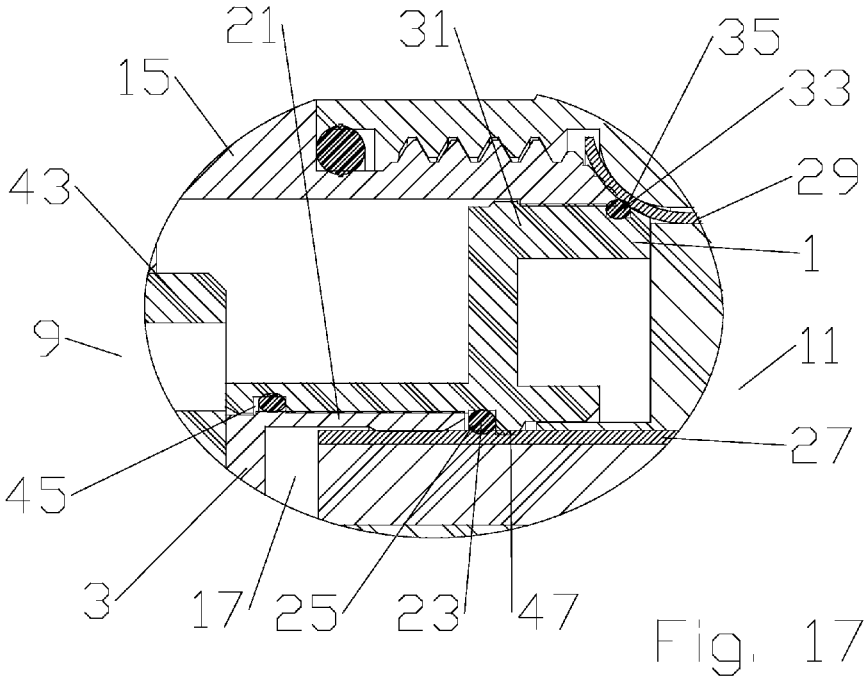
FIG. 17 is a close-up view of FIG. 16.

The interconnection cap 1 may be applied in embodiments similar to the first embodiment described in detail with respect to FIGS. 1-3, but where the inner contact 3 remains supported by a conventional separate insulator 43 and the interconnection cap 1 provides only sealing and/or characteristic impedance tuning for return loss optimization/coaxial cable matching. The outer diameter aligning portion 31 may be provided in an outer conductor aligning/flaring configuration, for example as shown in FIG. 14, or an outer conductor aligning/sealing configuration, for example as shown in FIGS. 15-17.

Figure 18:
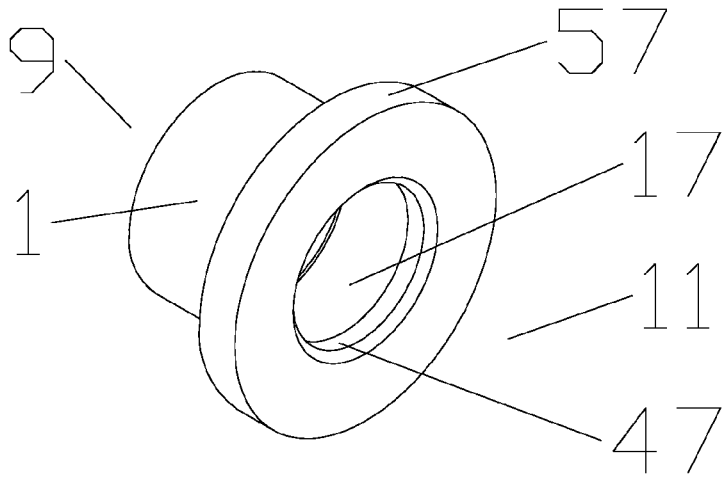
FIG. 18 is a schematic isometric view of another embodiment of an interconnection cap.
Figure 19:
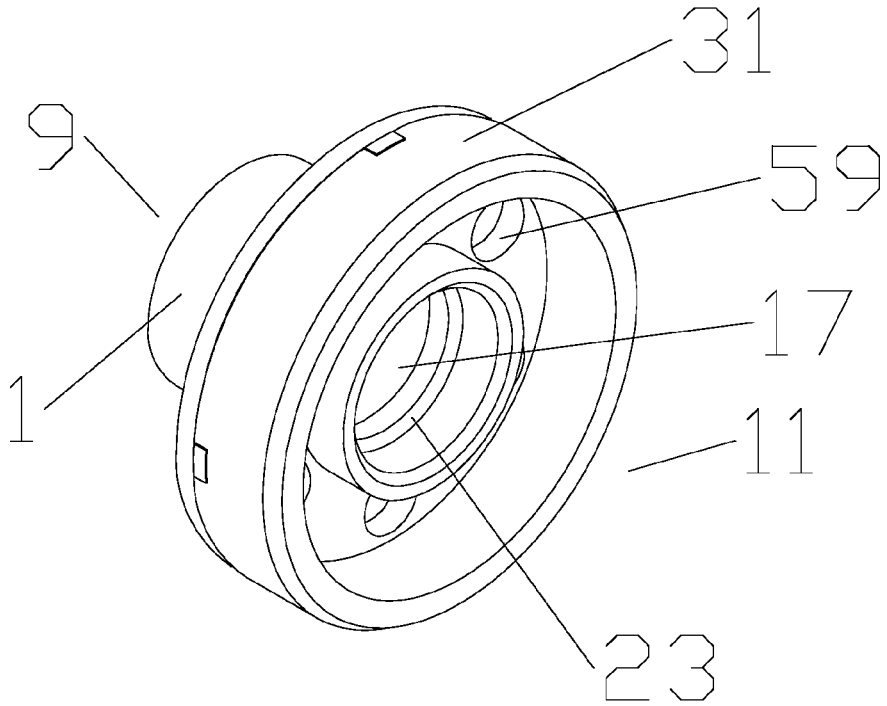
FIG. 19 is a schematic isometric view of another embodiment of an interconnection cap.

The configuration of the interconnection cap 1 impacts an impedance match between the overall coaxial connector assembly 5 and the coaxial cable 39. By varying the dimensions and/or selecting interconnection cap materials with different dielectric constants, the interconnection cap 1 may also or alternatively be utilized as a coaxial connector assembly characteristic impedance tuning element. One skilled in the art will appreciate that material selection and/or modification of the interconnection cap radial dimensions, including the addition, for example, of an outward projecting impedance matching shoulder 57 as shown for example in FIG. 18 and/or addition of aperture(s) 59 applied to the aligning portion 31, as shown for example in FIG. 19, enables characteristic impedance tuning of the interconnection cap 1 and therethrough of the coaxial connector assembly 5 without requiring redesign of existing coaxial connector configurations.

By providing a range of differently configured interconnection cap 1, a single coaxial connector assembly 5 may be field configured for high performance with specific coaxial cables, simply by exchanging the interconnection cap 1 prior to connector to cable installation.

An interconnection cap 1 according to the invention may provide an improved environmental seal located proximate the electrical interconnection connection between the inner conductor 27 and the inner contact 3, thus reducing opportunities for connector failure due to corrosion and/or oxidation inherent in metals such as aluminum alloys and/or when these metals are mechanically coupled to dissimilar metals. The interconnection cap 1 according to the invention is especially suited for use in electrical connectors for a coaxial cable 39 with an aluminum inner conductor 11 having a copper or other metal coating about the outer diameter surface. Because the exposed end of the inner conductor 27 and the metal coating edge exposed by cable end preparation for coaxial cable connector assembly 5 attachment is protected from moisture and/or air exposure, opportunities for accelerated corrosion of the exposed aluminum and/or related delamination of the metal coating are reduced, especially when a surface sealant 41 is applied to the cavity formed by the inner contact 3 and the bore 17 prior to insertion of the inner conductor 27, to further exclude air and/or moisture from the area of the electrical interconnection. Similarly, the interconnection cap 1 may be configured to provide a seal against the inner diameter of the outer conductor 29 further isolating the coaxial cable connector assembly 5 from any moisture that may be present in or migrating along the inside of the coaxial cable 39.

Although exemplary combinations of the coaxial cable connector assembly 5 and coaxial cable 39 are provided demonstrating outer conductor threaded clamp retention configurations for smooth coaxial cable(s) 39, one skilled in the art will recognize that the interconnection cap 1 is applicable to any desired combination of the coaxial cable connector assembly 5 and coaxial cable 39, including corrugated conductor cable configurations.

| Table of Parts | |
|---|---|
| 1 | interconnection cap |
| 3 | inner contact |
| 5 | coaxial cable connector assembly |
| 7 | dielectric body |
| 9 | connector end |
| 11 | cable end |
| 13 | mounting portion |
| 15 | connector body |
| 17 | bore |
| 19 | step |
| 21 | contact portion |
| 23 | first seal groove |
| 25 | inner conductor seal |
| 27 | inner conductor |
| 29 | outer conductor |
| 31 | aligning portion |
| 33 | second seal groove |
| 35 | outer conductor seal |
| 37 | material reduction groove |
| 39 | coaxial cable |
| 41 | surface sealant |
| 43 | insulator |
| 45 | third seal groove |
| 47 | inner conductor shoulder |
| 49 | connector end shoulder |
| 51 | stripping feature |
| 53 | stripping finger |
| 55 | scrape surface |
| 57 | impedance matching shoulder |
| 59 | aperture |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A coaxial connector in combination with an inner conductor interconnection cap, for interconnection with a coaxial cable provided with an inner conductor and an outer conductor, the combination comprising:

a connector body with an inner contact supported coaxial therewithin;

the interconnection cap provided with a bore therethrough, seated upon and circumferentially contacting an outer diameter of the inner contact and an outer diameter of the inner conductor;

the interconnection cap extending along the inner contact to cover a contact portion at a cable end of the inner contact;

the bore provided with an inward projecting inner conductor shoulder at the cable end, the inner conductor shoulder contacting an outer diameter of the inner conductor;

an outer diameter aligning portion of the interconnection cap proximate the cable end, the outer diameter aligning portion dimensioned to contact an inner diameter of the outer conductor when the outer conductor is coupled to the connector body;

wherein, the interconnection cap encloses an interconnection between the inner conductor and the inner contact.

2. The combination of claim 1, wherein a connector end of the interconnection cap abuts an insulator coaxially supporting the inner contact within the connector body.

3. The combination of claim 1, wherein an inner diameter of the inner conductor shoulder is provided with a scrape surface.

4. The combination of claim 1, further including an inward projecting connector end shoulder, the connector end shoulder retaining the interconnection upon the inner conductor via a snap fit.

5. The combination of claim 1, wherein the bore is provided with a taper between a minimum diameter proximate a cable end of the interconnection cap and a maximum diameter proximate a connector end of the interconnection cap.

6. The combination of claim 1, wherein an inner diameter of the bore longitudinally corresponding to the contact portion decreases between a connector end of the contact portion and a cable end of the contact portion.

7. The combination of claim 1, further including a plurality of stripping fingers, the stripping fingers arrayed around the cable end of the interconnection cap, projecting radially inward.

8. The combination of claim 1, further including a first seal groove provided in the bore proximate the cable end.

9. The combination of claim 8, further including an inner conductor seal seated in the first seal groove.

10. The combination of claim 1, further including a third seal groove provided in the bore proximate the connector end.

11. The combination of claim 1, further including a surface sealant.

12. The combination of claim 11, wherein the surface sealant is applied to a cable end of the bore.

13. The combination of claim 1, the outer diameter aligning portion provided with an annular second seal groove in an outer diameter; and an outer conductor seal disposed in the second seal groove dimensioned to seal between the interconnection cap and an inner diameter of the outer conductor when the outer conductor is coupled to the connector body.

14. The combination of claim 13, wherein the interconnection cap extends beyond the connector body at the cable end.

15. The combination of claim 1, further including a mounting portion supporting the inner contact coaxial with the connector body.

16. A coaxial connector in combination with an inner conductor interconnection cap, for interconnection with a coaxial cable provided with an inner conductor and an outer conductor, the combination comprising:

a connector body with an inner contact supported coaxial therewithin;

the interconnection cap provided with a bore therethrough, seated upon and circumferentially contacting an outer diameter of the inner contact and an outer diameter of the inner conductor;

the interconnection cap extending along the inner contact to cover a contact portion at a cable end of the inner contact;

an impedance matching shoulder projecting radially outward from an outer diameter of the interconnection cap;

the bore provided with an inward projecting inner conductor shoulder at the cable end, the inner conductor shoulder contacting an outer diameter of the inner conductor;

wherein, the interconnection cap encloses an interconnection between the inner conductor and the inner contact.

17. A method for impedance matching a coaxial connector with a desired coaxial cable, comprising the steps of:

applying an interconnection cap over an outer diameter of a contact portion of an inner contact of the coaxial connector;

the interconnection cap dimensioned to cover a longitudinal extent of the contact portion;

the interconnection cap formed of a material with a desired dielectric constant and radial dimensions selected to equalize an impedance characteristic of the coaxial connector with an impedance characteristic of the coaxial cable.

18. The method of claim 17, wherein the interconnection cap is formed from an elastomeric material, the elastomeric material biasing the inner contact against the inner conductor.

* * * * *